US011649413B2

(12) United States Patent
Matsuda et al.

(10) Patent No.: US 11,649,413 B2
(45) Date of Patent: May 16, 2023

(54) LUBRICATING OIL COMPOSITION FOR INTERNAL COMBUSTION ENGINE

(71) Applicant: ENEOS Corporation, Tokyo (JP)

(72) Inventors: Hiromitsu Matsuda, Tokyo (JP); Koji Hoshino, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 17/056,192

(22) PCT Filed: May 17, 2019

(86) PCT No.: PCT/JP2019/019803
§ 371 (c)(1),
(2) Date: Nov. 17, 2020

(87) PCT Pub. No.: WO2019/221296
PCT Pub. Date: Nov. 21, 2019

(65) Prior Publication Data

US 2021/0214640 A1 Jul. 15, 2021

(30) Foreign Application Priority Data

May 18, 2018 (JP) ..... JP2018-096500

(51) Int. Cl.

| | |
|---|---|
| ***C10M 169/04*** | (2006.01) |
| ***C10M 101/02*** | (2006.01) |
| ***C10M 107/10*** | (2006.01) |
| ***C10M 125/10*** | (2006.01) |
| ***C10M 135/18*** | (2006.01) |
| ***C10M 137/10*** | (2006.01) |
| *C10N 30/00* | (2006.01) |
| *C10N 10/04* | (2006.01) |
| *C10N 10/12* | (2006.01) |
| *C10N 20/02* | (2006.01) |
| *C10N 30/02* | (2006.01) |
| *C10N 30/04* | (2006.01) |
| *C10N 40/25* | (2006.01) |

(52) U.S. Cl.
CPC ..... *C10M 169/04* (2013.01); *C10M 101/025* (2013.01); *C10M 107/10* (2013.01); *C10M 125/10* (2013.01); *C10M 135/18* (2013.01); *C10M 137/10* (2013.01); *C10M 2201/062* (2013.01); *C10M 2205/0285* (2013.01); *C10M 2205/163* (2013.01); *C10M 2219/08* (2013.01); *C10M 2223/045* (2013.01); *C10N 2010/04* (2013.01); *C10N 2010/12* (2013.01); *C10N 2020/02* (2013.01); *C10N 2030/02* (2013.01); *C10N 2030/04* (2013.01); *C10N 2030/74* (2020.05); *C10N 2040/25* (2013.01)

(58) Field of Classification Search
CPC ..... C10M 169/04; C10M 101/025; C10M 107/10; C10M 125/10; C10M 135/18; C10M 137/10; C10M 2201/062; C10M 2205/0285; C10M 2205/163; C10M 2219/08; C10M 2223/045; C10N 2030/74
See application file for complete search history.

(56) References Cited

U.S. PATENT DOCUMENTS

| | | | | |
|---|---|---|---|---|
| 11,034,908 | B2 * | 6/2021 | Kusumoto | C10M 129/54 |
| 11,168,281 | B2 * | 11/2021 | Matsuda | C10M 139/00 |
| 2002/0142922 | A1 | 10/2002 | Yagishita et al. | |
| 2014/0373434 | A1 | 12/2014 | Takeshima et al. | |
| 2015/0322367 | A1 | 11/2015 | Patel et al. | |
| 2016/0230116 | A1 * | 8/2016 | Mosier | C10M 169/04 |
| 2017/0015927 | A1 * | 1/2017 | Fletcher | C10M 135/10 |
| 2017/0121627 | A1 * | 5/2017 | Ishikawa | C10M 141/08 |
| 2017/0198235 | A1 | 7/2017 | Kusumoto | |
| 2017/0369808 | A1 * | 12/2017 | Kusuhara | C10M 169/045 |
| 2018/0072962 | A1 | 3/2018 | Wada et al. | |
| 2018/0087001 | A1 * | 3/2018 | Mosier | C10M 155/04 |
| 2018/0258365 | A1 * | 9/2018 | Ohkubo | C10M 169/048 |
| 2018/0334636 | A1 * | 11/2018 | Hoshino | C10M 101/00 |
| 2019/0119601 | A1 * | 4/2019 | Onouchi | C10M 141/12 |
| 2020/0080018 | A1 | 3/2020 | Matsuda et al. | |
| 2020/0181524 | A1 | 6/2020 | Matsuda et al. | |
| 2020/0181529 | A1 * | 6/2020 | Suzuki | C10M 169/045 |
| 2021/0002577 | A1 * | 1/2021 | Mosier | C10M 101/00 |

FOREIGN PATENT DOCUMENTS

| | | |
|---|---|---|
| CN | 107541317 | 1/2018 |
| CN | 110637077 | 12/2019 |
| CN | 110662825 | 1/2020 |
| JP | 2003-155492 | 5/2003 |
| JP | 2006-299279 | 11/2006 |
| JP | 2017-043734 | 3/2017 |

(Continued)

OTHER PUBLICATIONS

K. Fujimoto et al., "Engine Oil Development for Preventing Pre-Ignition in Turbocharged Gasoline Engine", SAE Int. J. Fuels Lubr. 7(3):2014, doi:10.4271/2014-01-2785.
ISR issued in WIPO Patent Application No. PCT/JP2019/019803, dated Jul. 9, 2019, English translation.
IPRP issued in WIPO Patent Application No. PCT/JP2019/019803, dated Nov. 24, 2020, English translation.

*Primary Examiner* — Ellen M McAvoy
(74) *Attorney, Agent, or Firm* — Greenblum & Bernstein, P.L.C.

(57) ABSTRACT

A lubricating oil composition for an internal combustion engine includes: a lubricant base oil including at least one mineral base oil, at least one synthetic base oil, or any combination thereof, and having a kinematic viscosity at 100° C. of 3.0 to 4.0 $mm^2/s$ and a NOACK evaporation loss at 250° C. of no more than 15 mass %; (A) a calcium-containing metallic detergent in an amount of no less than 1000 mass ppm and less than 2000 mass ppm in terms of calcium; (B) a magnesium-containing metallic detergent in an amount of 100 to 1000 mass ppm in terms of magnesium; (G) a zinc dialkyl dithiophosphate in an amount of no less than 600 mass ppm in terms of phosphorus; and optionally (C) a viscosity index improver in an amount of no more than 5 mass %.

8 Claims, No Drawings

(56) References Cited

FOREIGN PATENT DOCUMENTS

| | | |
|---|---|---|
| JP | 2017-514982 | 6/2017 |
| JP | 2017-186461 | 10/2017 |
| JP | 2017-226793 | 12/2017 |
| WO | 2013/046484 | 4/2013 |
| WO | 2016/159006 | 10/2016 |
| WO | 2016/159258 | 10/2016 |

* cited by examiner

LUBRICATING OIL COMPOSITION FOR INTERNAL COMBUSTION ENGINE

FIELD

The present invention relates to a lubricating oil composition for internal combustion engines.

BACKGROUND

Lubricating oils are used for internal combustion engines, transmissions, and other machineries for their smooth operation. Specifically, lubricating oils for internal combustion engines (engine oils) are being required to have increasingly higher performance due to increasingly higher performance, increasingly higher power, and increasingly severer operation conditions, etc. of internal combustion engines. Various additives such as anti-wear agents, metallic detergents, ashless dispersants, and antioxidants are incorporated in conventional engine oils in order to satisfy the above required performance.

Recently, much higher fuel efficiency has been required of lubricating oils, and application of high viscosity index base oils and various friction modifiers is being considered.

CITATION LIST

Patent Literature

Patent Literature 1: JP 2003-155492 A
Patent Literature 2: WO 2016/159006 A1

Non Patent Literature

Non-Patent Literature 1: Fujimoto, K.; Yamashita, M.; Hirano, S.; Kato, K. et al., "Engine Oil Development for Preventing Pre-Ignition in Turbocharged Gasoline Engine", SAE Int. J. Fuels Lubr. 7(3):2014, doi:10.4271/2014-01-2785.

SUMMARY

Technical Problem

However, conventional lubricating oils are not necessarily enough in terms of fuel efficiency.

Examples of commonly known techniques for improving fuel efficiency include reducing a kinematic viscosity and increasing a viscosity index of a lubricating oil (a multigrade oil comprising a low viscosity base oil and a viscosity index improver in combination), and incorporating a friction reducing agent. When the viscosity of a lubricating oil is reduced, lubricating performance under severe lubricating conditions (under high temperature and high shear conditions) deteriorates due to the decrease in the viscosity of the lubricating oil or a base oil constituting the lubricating oil, which may lead to troubles such as wear, seizure, and fatigue failure, and an increased evaporation loss. Ashless and molybdenum friction modifiers are known as friction reducing agents. However, a fuel efficient lubricating oil which outperforms such a common lubricating oil containing a friction reducing agent is demanded.

It is necessary to make HTHS viscosity at 150° C. high ("HTHS viscosity" is also referred to as "high temperature high shear viscosity") so as to prevent troubles due to a decreased viscosity and to maintain durability. It is also necessary to make shear stability high so as to prevent viscosity decrease due to shear. It is advantageous to decrease kinematic viscosity at 40° C., kinematic viscosity at 100° C., and HTHS viscosity at 100° C. while keeping a HTHS viscosity at 150° C. at a certain level for further improving fuel efficiency while maintaining other performances for practical use. However, it is very difficult for conventional lubricating oils to realize all of the foregoing at the same time.

Moreover, recently, it has been proposed to replace conventional naturally aspirated engines with engines having a less displacement and equipped with a turbocharger (turbocharged downsized engine), so as to improve fuel efficiency of automobile engines, especially of automobile gasoline engines. Turbocharged downsized engines make it possible to reduce a displacement while maintaining engine power, and thus to improve fuel efficiency, owing to the turbocharger. Disadvantageously, turbocharged downsized engines may suffer a phenomenon that ignition occurs in a cylinder earlier than an expected timing (LSPI: Low Speed Pre-Ignition), when the torque is increased at a low rotation speed. LSPI leads to increase in energy loss, and thus to restriction on fuel efficiency improvement and low-speed torque improvement. Engine oils are suspected to have an influence on occurrence of LSPI.

So as to suppress LSPI, one may think of reducing a calcium detergent. As regards fuel efficiency, it is a common general technical means for improving fuel efficiency to increase the amount of a molybdenum friction modifier. A lubricating oil composition of such a formulation, though, tends to suffer inferior detergency.

For improving fuel efficiency, it is also effective to decrease viscosity of a base oil as described above. A less viscous base oil, though, tends to have more volatility. Thus, a fuel-efficient lubricating oil composition comprising a less viscous base oil tends to suffer increased consumption of the lubricating oil.

An object of the present invention is to provide a lubricating oil composition for an internal combustion engine which can improve fuel efficiency, LSPI suppression, lubricating oil consumption suppression, and detergency in a well-balanced manner.

Solution to Problem

The present invention encompasses the following aspects [1] to [11].

[1] A lubricating oil composition for an internal combustion engine, the composition comprising: a lubricant base oil comprising at least one mineral base oil, at least one synthetic base oil, or any combination thereof, the lubricant base oil having a kinematic viscosity at 100° C. of no less than 3.0 to Him % and less than 4.0 $mm^2/s$ and a NOACK evaporation loss at 250° C. of no more than 15 mass %; (A) a calcium-containing metallic detergent in an amount of no less than 1000 mass ppm and less than 2000 mass ppm in terms of calcium on the basis of the total mass of the composition; (B) a magnesium-containing metallic detergent in an amount of 100 to 1000 mass ppm in terms of magnesium on the basis of the total mass of the composition; (G) a zinc dialkyl dithiophosphate in an amount of no less than 600 mass ppm in terms of phosphorus on the basis of the total mass of the composition; and optionally (C) a viscosity index improver in an amount of no more than 5 mass % on the basis of the total mass of the composition.

[2] The lubricating oil composition according to [1], the component (C) comprising (C1) a poly(meth)acrylate viscosity index improver having a weight average molecular weight of no less than 100,000, in an amount of no less than 95 mass % on the basis of the total amount of the component (C).

[3] The lubricating oil composition according to [1] or [2], wherein the composition optionally comprises the component (C) in an amount of no more than 3 mass % on the basis of the total mass of the composition.

[4] The lubricating oil composition according to any one of [1] to [3], wherein the composition optionally comprises the component (C) in an amount of no more than 1 mass % on the basis of the total mass of the composition.

[5] The lubricating oil composition according to any one of [1] to [4], wherein the composition does not comprise the component (C).

[6] The lubricating oil composition according to any one of [1] to [5], further comprising: (D) a friction modifier.

[7] The lubricating oil composition according to [6], the component (D) comprising a molybdenum friction modifier.

[8] The lubricating oil composition according to any one of [1] to [7], wherein the lubricant base oil is at least one synthetic base oil.

[9] The lubricating oil composition according to any one of [1] to [8], wherein the composition has a HTHS viscosity at 150° C. of 1.7 to 2.0 mPa·s.

[10] The lubricating oil composition according to any one of [1] to [9], wherein the composition has a HTHS viscosity at 100° C. of 3.5 to 4.0 mPa·s.

[11] The lubricating oil composition according to any one of [1] to [10], wherein the composition has a NOACK evaporation loss at 250° C. of no more than 15 mass %.

In the present description, "kinematic viscosity at 100° C." means kinematic viscosity at 100° C. as defined in ASTM D-445, "HTHS viscosity at 150° C." means high temperature high shear viscosity at 150° C. as defined in ASTM D4683, "HTHS viscosity at 100° C." means high temperature high shear viscosity at 100° C. as defined in ASTM D4683, and "NOACK evaporation loss at 250° C." is an evaporation loss of the lubricating base oil or composition at 250° C. which is measured conforming to ASTM D 5800.

Advantageous Effects of Invention

The lubricating oil composition for an internal combustion engine of the present invention can improve fuel efficiency, LSPI suppression, lubricating oil consumption suppression, and detergency in a well-balanced manner.

DETAILED DESCRIPTION OF EMBODIMENTS

The present invention will be described hereinafter. Expression "A to B" concerning numeral values A and B means "no less than A and no more than B" unless otherwise specified. In such expression, if a unit is added only to the numeral value B, the unit is applied to the numeral value A as well. A word "or" means a logical sum unless otherwise specified. In the present description, expression "$E_1$ and/or $E_2$" concerning elements $E_1$ and $E_2$ means "$E_1$, or $E_2$, or the combination thereof", and expression "$E_1, \ldots, E_{N-1}$, and/or $E_N$" concerning elements $E_1, \ldots, E_N$ (N is an integer of 3 or more) means "$E_1, \ldots, E_{N-1}$, or $E_N$, or any combination thereof". In the present description, "alkaline earth metal" encompasses magnesium.

<Lubricating Base Oil>

A lubricating base oil comprising at least one mineral base oil or at least one synthetic base oil or any combination thereof, and having a kinematic viscosity at 100° C. of 3.0 to 4.0 $mm^2/s$ and a NOACK evaporation loss at 250° C. of no more than 15 mass % (hereinafter may be referred to as "lubricating base oil of the present embodiment") is used as a lubricating base oil. At least one Group II base oil of API base stock categories (hereinafter may be simply referred to as "API Group II base oil"), or at least one Group III base oil of API base stock categories (hereinafter may be simply referred to as "API Group III base oil"), or any combination thereof can be preferably used as the mineral base oil. At least one Group IV base oil of API base stock categories (hereinafter may be simply referred to as "API Group IV base oil"), or at least one Group V base oil of API base stock categories (hereinafter may be simply referred to as "API Group V base oil"), or any combination thereof can be preferably used as the synthetic base oil. API Group II base oils are mineral base oils containing no more than 0.03 mass % sulfur and no less than 90 mass % saturates, and having a viscosity index of no less than 80 and less than 120. API Group III base oils are mineral base oils containing no more than 0.03 mass % sulfur and no less than 90 mass % saturates, and having a viscosity index of no less than 120. API Group IV base oils are poly-α-olefin base oils. API Group V base oils are preferably ester base oils.

Examples of the mineral base oil include paraffinic mineral oils, normal-paraffinic base oils, isoparaffinic base oils, and any mixtures thereof, having a kinematic viscosity at 100° C. of 3.0 to 4.0 $mm^2/s$, and a NOACK evaporation loss at 250° C. of no more than 15 mass %, which are obtained by refining lubricating oil fractions that are obtained by distillation under atmospheric pressure and/or distillation under reduced pressure of crude oil, through a refining process including solvent deasphalting, solvent extraction, hydrocracking, solvent dewaxing, catalytic dewaxing, hydrorefining, sulfuric acid washing, or white clay treatment, or the like, or any combination thereof.

Preferred examples of the mineral base oil include a base oil obtained by (i) refining a raw material base oil of any one of the following (1) to (8) and/or lubricating oil fractions recovered from the raw material base oil, by a predetermined refining method, and then (ii) recovering lubricating oil fractions therefrom:

(1) a distillate obtained by atmospheric distillation of a paraffin base crude oil and/or a mixed base crude oil;

(2) a distillate obtained by vacuum distillation of residue of atmospheric distillation of a paraffin base crude oil and/or a mixed base crude oil (WVGO);

(3) a wax obtained through a lubricating oil dewaxing step (slack wax or the like) and/or a synthetic wax obtained through a gas-to-liquid (GTL) process or the like (Fischer-Tropsch wax, GTL wax, or the like);

(4) a mixed oil of at least one selected from the base oils (1) to (3), and/or a mild hydrocracked oil of the mixed oil;

(5) a mixed oil of at least two selected from the base oils (1) to (4);

(6) a deasphalted oil (DAO) of the base oil (1), (2), (3), (4) or (5);

(7) a mild hydrocracked oil (MHC) of the base oil (6); and (8) a mixed oil of at least two selected from the base oils (1) to (7).

Preferred examples of the above described predetermined refining method include: hydrorefining such as hydrocracking and hydrofinishing; solvent refining such as furfural solvent extraction; dewaxing such as solvent dewaxing and catalytic dewaxing; white clay treatment using acid white clay, activated white clay, or the like; and chemical (acid or alkali) washing such as sulfuric acid washing and caustic soda washing. One of these refining methods may be used alone, or at least two of them may be used in combination. When at least two of the refining methods are used in combination, the order of using them is not specifically restricted, but can be suitably determined.

The following base oil (9) or (10) is especially preferable as the mineral base oil. The base oil (9) or (10) is obtained through a predetermined process on a base oil selected from the base oils (1) to (8), or on lubricating oil fractions recovered from the selected base oil:

(9) a hydrocracked base oil obtained by: hydrocracking a base oil selected from the base oils (1) to (8) or lubricating oil fractions recovered from the selected base oil; dewaxing the hydrocracked product or lubricating oil fractions recovered therefrom by distillation or the like, through a dewaxing process such as solvent dewaxing and catalytic dewaxing; and optionally further distilling the dewaxed product; and

(10) a hydroisomerized base oil obtained by: hydroisomerizing a base oil selected from the base oils (1) to (8) or lubricating oil fractions recovered from the selected base oil; carrying out a dewaxing process such as solvent dewaxing and catalytic dewaxing on the hydroisomerized product or lubricating oil fractions recovered therefrom by distillation or the like; and optionally further distilling the dewaxed product. A base oil produced via catalytic dewaxing as the dewaxing process is preferable.

When the lubricating base oil (9) or (10) is obtained, a solvent refining process and/or hydrofinishing process may be further performed at a proper stage if necessary.

A catalyst used for the above described hydrocracking or hydroisomerization is not specifically restricted. Preferred examples thereof include a hydrocracking catalyst including metal having a hydrogenating ability (such as at least one metal of the group VIa and group VIII of the periodic table) supported on a catalyst support, the catalyst support including at least one composite oxide having a cracking activity (such as silica-alumina, alumina-boria and silica-zirconia) and optionally further including a binder binding the at least one composite oxide; and a hydroisomerization catalyst including metal having a hydrogenation ability including at least one group VIII metal, the metal being supported on a catalyst support, the catalyst support including a zeolite (such as ZSM-5, zeolite beta, and SAPO-11). The hydrocracking catalyst and the hydroisomerization catalyst may be used in combination by stacking, mixing, or the like.

The reaction conditions upon hydrocracking or hydroisomerization are not specifically restricted. Preferably, the hydrogen partial pressure is 0.1 to 20 MPa, the average reaction temperature is 150 to 450° C., LHSV is 0.1 to 3.0 $hr^{-1}$, and the hydrogen/oil ratio is 50 to 20000 scf/b.

The kinematic viscosity of the lubricating base oil at 100° C. is 3.0 to 4.0 $mm^2/s$. The kinematic viscosity of the lubricating base oil at 100° C. of no less than 3.0 $mm^2/s$ offers enough oil film formation at a lubricating point, and makes it possible to suppress the evaporation loss of the lubricating oil composition to reduce the consumption of the lubricating oil. The kinematic viscosity of the lubricating base oil at 100° C. of no more than 4.0 $mm^2/s$ offers improved fuel efficiency.

The kinematic viscosity of the lubricating base oil at 40° C. is preferably 10 to 40 $mm^2/s$, more preferably 12 to 30 $mm^2/s$, further preferably 14 to 25 $mm^2/s$, especially preferably 14 to 22 $mm^2/s$, and most preferably 14 to 20 $mm^2/s$. The kinematic viscosity of the lubricating base oil at 40° C. at this upper limit or below can improve low-temperature viscosity characteristics of the lubricating oil composition, and further improve fuel efficiency. The kinematic viscosity of the lubricating base oil at 40° C. at this lower limit or over offers enough oil film formation at a lubricating point and thus improved lubricity, and offers further reduced evaporation loss of the lubricating oil composition and thus further reduced consumption of the lubricating oil.

In the present description, "kinematic viscosity at 40° C." means kinematic viscosity at 40° C. as defined in ASTM D-445.

The viscosity index of the lubricating base oil is preferably no less than 100, more preferably no less than 105, further preferably no less than 110, especially preferably no less than 115, and most preferably no less than 120. The viscosity index at this lower limit or over can improve viscosity-temperature characteristics and anti-wear performance of the lubricating oil composition, further improve fuel efficiency, and further reduce the evaporation loss of the lubricating oil to further reduce the consumption of the lubricating oil. The viscosity index in the present description means viscosity index measured conforming to JIS K 2283-1993.

The NOACK evaporation loss of the lubricating base oil at 250° C. is no more than 15 mass %. The lower limit of the NOACK evaporation loss of the lubricating base oil at 250° C. is not specifically restricted, but normally no less than 5 mass %.

The pour point of the lubricating base oil is preferably no more than −10° C., more preferably no more than −12.5° C., and further preferably no more than −15° C. The pour point at this upper limit or below can improve low-temperature fluidity of the entire lubricating oil composition. The pour point in the present description means pour point measured conforming to JIS K 2269-1987.

The sulfur content in the lubricating base oil depends on the sulfur content in the raw material thereof. For example, if a raw material that is substantially sulfur free, such as a synthetic wax component obtained through Fischer-Tropsch reaction or the like, is used, a lubricating base oil that is substantially sulfur free can be obtained. If a raw material containing sulfur, such as slack wax obtained through the process of refining the lubricating base oil, and microwax obtained through a wax refining process, is used, the sulfur content in the obtained lubricating base oil is usually no less than 100 mass ppm. In view of decrease in the sulfur content of the lubricating oil composition, the sulfur content of the lubricating base oil is preferably no more than 100 mass ppm, more preferably no more than 50 mass ppm, further preferably no more than 10 mass ppm, and especially preferably no more than 5 mass ppm.

The nitrogen content in the lubricating base oil is preferably no more than 10 mass ppm, more preferably no more than 5 mass ppm, and further preferably no more than 3 mass ppm. The nitrogen content in the present description means nitrogen content measured conforming to JIS K 2609-1990.

% $C_P$ of the mineral base oil is preferably 70 to 99, more preferably 70 to 95, further preferably 75 to 95, and especially preferably 75 to 94. % $C_P$ of the base oil at this lower limit or over can improve viscosity-temperature characteristics, and can further improve fuel efficiency; and can sufficiently bring out an effect of an additive when the additive is incorporated to the base oil. % $C_P$ of the base oil at this upper limit or below can improve solubility of an additive.

% $C_A$ of the mineral base oil is preferably no more than 2, more preferably no more than 1, further preferably no more than 0.8, and especially preferably no more than 0.5. % $C_A$ of the base oil at this upper limit or below can improve viscosity-temperature characteristics, and can further improve fuel efficiency.

% $C_N$ of the mineral base oil is preferably 1 to 30, and more preferably 4 to 25. % $C_N$ of the base oil at this upper limit or below can improve viscosity-temperature characteristics, and can further improve fuel efficiency. % $C_N$ of the base oil at this lower limit or over can improve solubility of an additive.

In the present description, % $C_P$, % $C_N$ and % $C_A$ mean percentage of the paraffinic carbons to the total carbons, percentage of the naphthenic carbons to the total carbons, and percentage of the aromatic carbons to the total carbons, respectively, obtained by the method conforming to ASTM D 3238-85 (ring analysis by the n-d-M method). That is, the above described preferred ranges of % $C_P$, % $C_N$ and % $C_A$ are based on values obtained according to the above method. For example, the value of % $C_N$ obtained according to the above method may be more than 0 even if the lubricating base oil does not include the naphthene content.

The saturated content in the mineral base oil is preferably no less than 90 mass %, preferably no less than 95 mass %, and more preferably no less than 99 mass %, on the basis of the total mass of the base oil. The saturated content at this lower limit or over can improve viscosity-temperature characteristics. In the present description, the saturated content represents a value measured conforming to ASTM D 2007-93.

Any similar method according to which the same result is obtained can be used for a separation method for the saturated content. Examples thereof include the method as defined in the above ASTM D 2007-93, the method as defined in ASTM D 2425-93, the method as defined in ASTM D 2549-91, any method using high performance liquid chromatography (HPLC), and improved methods thereof.

The aromatic content in the mineral base oil is preferably 0 to 10 mass %, more preferably 0 to 5 mass %, and especially preferably 0 to 1 mass %, and in one embodiment, may be no less than 0.1 mass %, on the basis of the total mass of the base oil. The aromatic content at this upper limit or below can improve viscosity-temperature characteristics and low-temperature viscosity characteristics, can further improve fuel efficiency, and can further reduce the evaporation loss of the lubricating oil to further reduce the consumption of the lubricating oil; and can sufficiently bring out an effect of an additive when the additive is incorporated to the lubricating base oil. The lubricating base oil may contain no aromatic content. The aromatic content at this lower limit or over however can further improve solubility of an additive.

In the present description, the aromatic content represents a value measured conforming to ASTM D 2007-93. Aromatic content usually includes alkylbenzenes, and alkylnaphthalenes; anthracenes, phenanthrenes and alkylated compounds thereof; compounds having four or more fused benzene rings; and aromatic compounds each having a heteroatom such as pyridines, quinolines, phenols, and naphthols.

Any synthetic base oil such as: poly α-olefins and hydrogenated products thereof, isobutene oligomers and hydrogenated products thereof, isoparaffins, alkylbenzenes, alkylnaphthalenes, diesters (such as ditridecyl glutarate, bis-2-ethylhexyl adipate, diisodecyl adipate, ditridecyl adipate, and bis-2-ethylhexyl sebacate), polyol esters (such as trimethylolpropane caprylate, trimethylolpropane pelargonate, pentaerythritol 2-ethylhexanoate, and pentaerythritol pelargonate), polyoxyalkylene glycols, dialkyl diphenyl ethers, polyphenyl ethers, and mixtures thereof; each having a kinematic viscosity at 100° C. of 3.0 to 4.0 $mm^2/s$, and a NOACK evaporation loss at 250° C. of no more than 15 mass %, can be used as the synthetic base oil. Among them, a poly α-olefin base oil is preferable. Typical examples of poly α-olefin base oils include oligomers and co-oligomers of α-olefins having a carbon number of 2-32, preferably 6-16 (such as 1-octene oligomers, decene oligomers, and ethylene-propylene co-oligomers), and hydrogenated products thereof.

The method for producing the poly α-olefins is not specifically restricted. Examples thereof include polymerizing an α-olefin in the presence of a polymerization catalyst such as a catalyst containing a complex of aluminum trichloride or boron trifluoride, and water, an alcohol (such as ethanol, propanol, and butanol), a carboxylic acid or an ester.

The lubricating base oil may comprise one base oil component, or may comprise a plurality of base oil components as long as a kinematic viscosity of the whole of the base oil (total base oil) at 100° C. is 3.0 to 4.0 $mm^2/s$, and a NOACK evaporation loss of the whole of the base oil (total base oil) at 250° C. is no more than 15 mass %.

The content of the lubricating base oil (total base oil) in the lubricating oil composition is usually 75 to 95 mass %, and preferably 85 to 95 mass %, on the basis of the total mass of the composition.

<(A), (B): Metallic Detergents>

As metallic detergents, the lubricating oil composition of the present invention comprises (A) a calcium-containing metallic detergent (hereinafter may be referred to as "component (A)" or "calcium detergent"), and (B) a magnesium-containing metallic detergent (hereinafter may be referred to as "component (B)" or "magnesium detergent"). Examples of the metallic detergents include a phenate detergent, a sulfonate detergent, and a salicylate detergent. Among them, one metallic detergent may be used alone, or two or more metallic detergents may be used in combination.

Preferred examples of a phenate detergent include overbased salts of alkaline earth metal salts of compounds having any structures represented by the following formula (1). Magnesium and calcium are preferable as the alkaline earth metals.

(1)

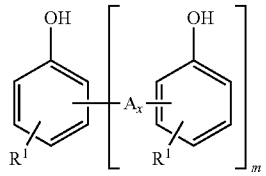

In the formula (1), $R^1$ is a $C_{6-21}$ linear or branched chain, saturated or unsaturated alkyl or alkenyl group; m represents a polymerization degree, and is an integer of 1 to 10; A is a sulfide (—S—) group or a methylene (—$CH_2$—) group; and x is an integer of 1 to 3. $R^1$ may be any combination of at least two different groups.

The carbon number of $R^1$ in the formula (1) is preferably 9 to 18, and more preferably 9 to 15. The carbon number of $R^1$ at this lower limit or over can improve solubility in the base oil. The carbon number of $R^1$ at this upper limit or below facilitates production of the compound.

The polymerization degree m in the formula (1) is preferably 1 to 4.

Preferred examples of a sulfonate detergent include alkaline earth metal salts of alkyl aromatic sulfonic acids obtained by sulfonation of alkylaromatics, and basic or overbased salts thereof. The weight average molecular weight of the alkylaromatics is preferably 400 to 1500, and more preferably 700 to 1300.

Magnesium or calcium is preferable as the alkaline earth metal. Examples of the alkyl aromatic sulfonic acids include what is called petroleum sulfonic acids and synthetic sulfonic acids. Examples of petroleum sulfonic acids here include sulfonated products of alkylaromatics of lubricating oil fractions derived from mineral oils, and what is called mahogany acid, which is a side product of white oils. One example of synthetic sulfonic acids is a sulfonated product of an alkylbenzene having a linear or branched alkyl group, obtained by recovering side products in a manufacturing plant of alkylbenzenes, which are raw materials of detergents, or by alkylating benzene with a polyolefin. Another example of synthetic sulfonic acids is a sulfonated product of an alkylnaphthalene such as dinonylnaphthalene. A sulfonating agent used when sulfonating these alkylaromatics is not specifically limited, and for example, a fuming sulfuric acid or a sulfuric anhydride can be used.

Preferred examples of a salicylate detergent include metal salicylates, and basic or overbased salts thereof. Preferred examples of metal salicylates include compounds represented by the following formula (2):

(2)

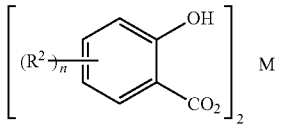

In the formula (2), $R^2$ each independently represent a $C_{14-30}$ alkyl or alkenyl group, M is an alkaline earth metal, and n is 1 or 2. M is preferably calcium or magnesium, and n is preferably 1. When n is 2, $R^2$ may be any combination of different groups.

One preferred embodiment of the salicylate detergent is an alkaline earth metal salicylate of the formula (2) wherein n is 1, or a basic or overbased salt thereof.

The method for producing the alkaline earth metal salicylate is not specifically restricted, but for example, any known method for producing monoalkylsalicylates can be used. For example, the alkaline earth metal salicylate can be obtained by: making a metal base such as an oxide and hydroxide of an alkaline earth metal react with monoalkylsalicylic acid obtained by alkylating a phenol as starting material with an olefin, and then carboxylating the resultant product with carbonic acid gas or the like, monoalkylsalicylic acid obtained by alkylating a salicylic acid as starting material with an equivalent of the olefin, or the like; or once converting the above monoalkylsalicylic acid or the like to an alkali metal salt such as a sodium salt and a potassium salt, and then performing transmetallation with an alkaline earth metal salt; or the like.

The metallic detergents may be carbonate salt (such as alkaline earth metal carbonate salt e.g. calcium carbonate and magnesium carbonate)-overbased, or may be borate salt (such as alkaline earth metal carbonate salt e.g. calcium borate and magnesium borate)-overbased.

The method for obtaining an alkaline earth metal carbonate salt-overbased metallic detergent is not specifically limited. For example, such a metallic detergent can be obtained by reacting a neutral salt of a metallic detergent (such as an alkaline earth metal phenate, an alkaline earth metal sulfonate, and an alkaline earth metal salicylate) with a base of an alkaline earth metal (such as a hydroxide and an oxide of an alkaline earth metal) in the presence of carbonic acid gas.

The method for obtaining an alkaline earth metal borate salt-overbased metallic detergent is not specifically limited. Such a metallic detergent can be obtained by reacting a neutral salt of a metallic detergent (such as an alkaline earth metal phenate, an alkaline earth metal sulfonate, and an alkaline earth metal salicylate) with a base of an alkaline earth metal (such as a hydroxide and an oxide of an alkaline earth metal) in the presence of a boric acid or a boric acid anhydride and optionally a borate salt. Boric acid may be orthoboric acid, or condensed boric acid (such as diboric acid, triboric acid, tetraboric acid, and metaboric acid). A calcium salt of such boric acid (when the component (A) is to be obtained), or a magnesium salt thereof (when the component (B) is to be obtained) can be preferably used as a borate salt. The borate salt may be a neutral salt, or an acidic salt. One type of the boric acid and/or borate salt may be used alone, or two or more thereof may be used in combination.

As the component (A), for example, a calcium phenate detergent, a calcium sulfonate detergent, a calcium salicylate detergent, or any combination thereof can be used. The component (A) preferably contains at least an overbased calcium salicylate detergent. The component (A) may be calcium carbonate-overbased, or may be calcium borate-overbased.

As the component (B), for example, a magnesium phenate detergent, a magnesium sulfonate detergent, a magnesium salicylate detergent, or any combination thereof can be used. The component (B) preferably contains an overbased magnesium sulfonate detergent. The component (B) may be magnesium carbonate-overbased, or may be magnesium borate-overbased.

The metal content in the metallic detergents is usually 1.0 to 20 mass %, and preferably 2.0 to 16 mass %.

The base number of the calcium detergent (component (A)) is preferably 150 to 350 mgKOH/g, more preferably 150 to 300 mgKOH/g, and especially preferably 150 to 250 mgKOH/g. The base number in the present description means a base number measured by the perchloric acid method conforming to JIS K2501. Generally, a metallic detergent is obtained by reaction in a diluent such as a solvent and a lubricating base oil. Therefore, a metallic detergent is on the market as diluted in a diluent such as a lubricating base oil. In the present description, the base number of a metallic detergent shall mean a base number as a diluent is contained. In the present description, the metal content of a metallic detergent shall mean metal content as a diluent is contained.

The content of the component (A) in the lubricating oil composition is no less than 1000 mass ppm and less than 2000 mass ppm, and more preferably 1000 to 1500 mass ppm, in terms of calcium on the basis of the total mass of the lubricating oil composition. The content of the component (A) in terms of calcium of less than 2000 mass ppm makes it possible to suppress the increase in the ash content in the composition while LSPI suppression effect is obtained. The content of the component (A) in terms of calcium at the above lower limit or more offers improved detergency and base number retention properties.

The base number of the magnesium detergent (component (B)) is preferably 200 to 600 mgKOH/g, more preferably 250 to 550 mgKOH/g, and especially preferably 300 to 500 mgKOH/g.

The content of the component (B) in the lubricating oil composition is 100 to 1000 mass ppm, preferably 150 to 800 mass ppm, and more preferably 200 to 500 mass ppm, in terms of magnesium on the basis of the total mass of the lubricating oil composition. The content of the component (B) in terms of magnesium at this lower limit or over can improve detergency while LSPI is suppressed. The content of the component (B) in terms of magnesium at this upper limit or below can further improve fuel efficiency.

<(C) Viscosity Index Improver>

Preferably, the lubricating oil composition of the present invention optionally comprises (C) a viscosity index improver (hereinafter may be referred to as "component (C)") in an amount of no more than 5 mass % on the basis of the total mass of the composition. That is, the content of the viscosity index improver in the lubricating oil composition is preferably 0 to 5 mass %, more preferably 0 to 3 mass %, and further preferably 0 to 1 mass %, on the basis of the total mass of the composition. Examples of the component (C) include non-dispersant or dispersant poly (meth)acrylate viscosity index improvers, (meth)acrylate-olefin copolymers, non-dispersant or dispersant ethylene-α-olefin copolymers or hydrogenated products thereof, polyisobutylene or hydrogenated products thereof, hydrogenated styrene-diene copolymers, styrene-maleic anhydride/ester copolymers, and polyalkylstyrene. The content of the component (C) in the lubricating oil composition at the above upper limit or less can improve the detergency and fuel efficiency of the lubricating oil composition.

When the lubricating oil composition comprises the component (C), the component (C) preferably comprises: (C1) a poly(meth)acrylate viscosity index improver having a weight average molecular weight of no less than 100,000 (hereinafter may be referred to as "component (C1)"). The content of the component (C1) in the component (C) is preferably no less than 95 mass %, and may be mass %, on the basis of the total mass of the component (C).

The weight average molecular weight (Mw) of the component (C1) is no less than 100,000, preferably 200,000 to 1,000,000, more preferably 200,000 to 700,000, and further preferably 200,000 to 500,000. The weight average molecular weight at this lower limit or over can enhance viscosity index improvement effect to improve low-temperature viscosity characteristics and to further improve fuel efficiency, and makes it possible to lower the cost. The weight average molecular weight at this upper limit or below makes it possible to keep viscosity increase effect within a proper range to improve low-temperature viscosity characteristics and further improve fuel efficiency, and can improve solubility in the lubricating base oil and storage stability, and further improve shear stability.

The component (C1) preferably comprises a poly(meth) acrylate viscosity index improver comprising 10 to 90 mol % of the structural units represented by the following general formula (3) on the basis of the total monomer units in the polymer (hereinafter may be referred to as "viscosity index improver of the present embodiment"). In the present description, "(meth)acrylate" means "acrylate and/or methacrylate".

(3)

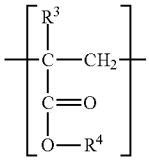

In the formula (3), $R^3$ is hydrogen or a methyl group, and $R^4$ is a linear or branched chain $C_{1-5}$ hydrocarbon group.

The content of the (meth)acrylate structural units represented by the general formula (3) in the polymer in the viscosity index improver of the present embodiment is preferably 10 to 90 mol %, more preferably 20 to 90 mol %, further preferably 30 to 80 mol %, and especially preferably 40 to 70 mol %. The content of the (meth)acrylate structural units represented by the general formula (3) on the basis of the total monomer units in the polymer at this upper limit or below can improve solubility in the base oil and low-temperature viscosity characteristics, and enhance improvement effect on viscosity-temperature characteristics. The content at this lower limit or over can enhance improvement effect on viscosity-temperature characteristics.

The viscosity index improver of the present embodiment may be a copolymer comprising another (meth)acrylate structural unit in addition to the (meth)acrylate structural unit represented by the general formula (3). Such a copolymer can be obtained by copolymerizing at least one monomer represented by the following general formula (4) (hereinafter referred to as "monomer (M-1)"), and at least one monomer other than the monomer (M-1).

(4)

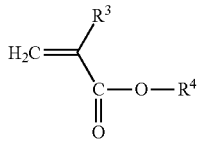

In the formula (4), $R^3$ represents hydrogen or a methyl group, and $R^4$ represents a linear or branched chain $C_{1-5}$ hydrocarbon group, preferably alkyl group.

The monomer copolymerized with the monomer (M-1) is not particularly limited. Preferred examples thereof include at least one monomer represented by the following general formula (5) (hereinafter referred to as "monomer (M-2)"), or at least one monomer represented by the following general formula (6) (hereinafter referred to as "monomer (M-3)"), or any combination thereof. A copolymer of the monomer (M-1) and the monomer (M-2) and/or the monomer (M3) is a so-called non-dispersant poly(meth)acrylate viscosity index improver.

(5)

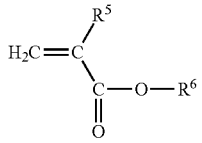

In the formula (5), $R^5$ represents a hydrogen atom or a methyl group, and $R^6$ represents a linear or branched chain $C_{6-18}$ hydrocarbon group, preferably alkyl group.

(6)

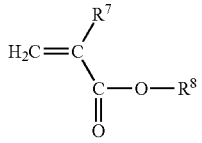

In the formula (6), $R^7$ represents a hydrogen atom or a methyl group, and $R^8$ represents a linear or branched chain hydrocarbon group, preferably alkyl group having a carbon number of no less than 19.

$R^8$ in the monomer (M-3) represented by the formula (6) is a linear or branched chain hydrocarbon group having a carbon number of no less than 19 as described above, preferably a linear or branched chain $C_{20-50,000}$ hydrocarbon group, or a linear or branched chain $C_{22-500}$ hydrocarbon group, or a linear or branched chain $C_{24-100}$ hydrocarbon group, or a branched chain $C_{24-50}$ hydrocarbon group, or a branched chain $C_{24-40}$ hydrocarbon group.

In the viscosity index improver of the present embodiment, the content of the structural units corresponding to the monomer (M-2) represented by the general formula (5) on the basis of the total monomer units in the polymer is preferably 3 to 75 mol %, more preferably 5 to 65 mol %, further preferably 10 to 55 mol %, and especially preferably 15 to 45 mol %, and for example, may be 15 to 35 mol %. The content of the structural units corresponding to the monomer (M-2) represented by the general formula (5) on the basis of the total monomer units in the polymer at this upper limit or below can improve solubility in the base oil and low-temperature viscosity characteristics, and enhance improvement effect on viscosity-temperature characteristics. The content at this lower limit or over can enhance improvement effect on viscosity-temperature characteristics.

In the viscosity index improver of the present embodiment, the content of the structural units corresponding to the monomer (M-3) represented by the general formula (6) on the basis of the total monomer units in the polymer is preferably 0.5 to 70 mol % or 1 to 70 mol %, more preferably 3 to 60 mol %, further preferably 5 to 50 mol %, and especially preferably 10 to 40 mol %, and for example, may be 10 to 30 mol %. The content of the structural units corresponding to the monomer (M-3) represented by the general formula (6) on the basis of the total monomer units in the polymer at this upper limit or below can enhance improvement effect on viscosity-temperature characteristics and improve low-temperature viscosity characteristics. The content at this lower limit or over can enhance improvement effect on viscosity-temperature characteristics.

In one embodiment, the content of the structural units corresponding to the monomers (M-1), (M-2) and (M-3) on the basis of the total monomer units in the polymer can be such that: monomer (M-1):monomer (M-2):monomer (M-3) equals 10 to 90 mol %:3 to 75 mol %:1 to 70 mol %, or 20 to 90 mol %:5 to 65 mol %:3 to 60 mol %, or 30 to 80 mol %:10 to 55 mol %:5 to 50 mol %, or 40 to 70 mol %:15 to 45 mol %:10 to 40 mol %.

At least one monomer represented by the following general formula (7) (hereinafter referred to as "monomer (M-4)"), or at least one monomer represented by the following general formula (8) (hereinafter referred to as "monomer (M-5)"), or any combination thereof is preferable as the other monomer copolymerized with the monomer (M-1). A copolymer of the monomer (M-1) and the monomer(s) (M-4) and/or (M-5) is a so-called dispersant poly (meth)acrylate viscosity index improver. This dispersant poly(meth)acrylate viscosity index improver may further contain the monomer(s) (M-2) and/or (M-3) as (a) constituting monomer(s).

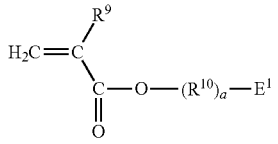

(7)

In the formula (7), $R^9$ represents a hydrogen atom or a methyl group, $R^{10}$ represents a $C_{1-18}$ alkylene group, $E^1$ represents an amine residue or heterocyclic residue having 1 to 2 nitrogen atom(s), and 0 to 2 oxygen atom(s), and a represents 0 or 1.

Examples of $C_{1-18}$ alkylene groups represented by $R^{10}$ include ethylene group, propylene group, butylene group, pentylene group, hexylene group, heptylene group, octylene group, nonylene group, decylene group, undecylene group, dodecylene group, tridecylene group, tetradecylene group, pentadecylene group, hexadecylene group, heptadecylene group, and octadecylene group (each alkylene group may be a linear or branched chain).

Examples of residues represented by $E^1$ include dimethylamino group, diethylamino group, dipropylamino group, dibutylamino group, anilino group, toluidino group, xylidino group, acetylamino group, benzoylamino group, morpholino group, pyrrolyl group, pyrrolino group, pyridyl group, methylpyridyl group, pyrrolidinyl group, pyrrolidino group, piperidinyl group, piperidino group, quinolyl group, pyrrolidonyl group, pyrrolidono group, imidazolino group, and pyrazinyl group.

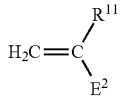

(8)

In the formula (8), $R^{11}$ represents a hydrogen atom or a methyl group, and $E^2$ represents an amine residue or heterocyclic residue having 1 to 2 nitrogen atom(s), and 0 to 2 oxygen atom(s).

Examples of residues represented by $E^2$ include dimethylamino group, diethylamino group, dipropylamino group, dibutylamino group, anilino group, toluidino group, xylidino group, acetylamino group, benzoylamino group, morpholino group, pyrrolyl group, pyrrolino group, pyridyl group, methylpyridyl group, pyrrolidinyl group, pyrrolidino group piperidinyl group, piperidino group, quinolyl group, pyrrolidonyl group, pyrrolidono group, imidazolino group, and pyrazinyl group.

Preferred specific examples of the monomers (M-4) and (M-5) include dimethylaminomethyl methacrylate, diethylaminomethyl methacrylate, dimethylaminoethyl methacrylate, diethylaminoethyl methacrylate, 2-methyl-5-vinylpyridine, morpholinomethyl methacrylate, morpholino ethyl methacrylate, N-vinylpyrrolidone, and mixtures thereof.

The copolymerization molar ratio of any copolymer of the monomer (M-1) and the monomers (M-2) to (M-5) is not specifically restricted, but monomer (M-1):monomers (M-2) to (M-5) is preferably approximately 20:80 to 90:10, more preferably 30:70 to 80:20, and further preferably 40:60 to 70:30.

The method for producing the viscosity index improver of the present embodiment is not particularly limited. For example, a non-dispersant poly(meth)acrylate compound can be easily obtained by radical solution polymerization of the monomer (M-1) and the monomer(s) (M-2) and/or (M-3) in the presence of a polymerization initiator (such as benzoyl peroxide). For another example, a dispersant poly(meth) acrylate compound can be easily obtained by polymerizing the monomer (M-1), at least one nitrogen-containing monomer selected from the monomers (M-4) and (M-5), and optionally the monomer(s) (M-2) and/or (M-3) by radical solution polymerization in the presence of a polymerization initiator.

<(D) Friction Modifier>

The lubricating oil composition of the present invention preferably comprises (D) a friction modifier (hereinafter may be referred to as "component (D)"). As the friction modifier, a molybdenum friction modifier (oil-soluble organic molybdenum compound), or an ashless friction modifier, or any combination thereof can be preferably used.

When the lubricating oil composition of the present invention comprises a molybdenum friction modifier as the component (D), molybdenum dithiocarbamate (sulfurized molybdenum dithiocarbamate or sulfurized oxymolybdenum dithiocarbamate, which may be hereinafter referred to as "component (D1)") can be preferably used as the molybdenum friction modifier.

Any compound represented by the following general formula (9) can be used as the component (D1).

(9)

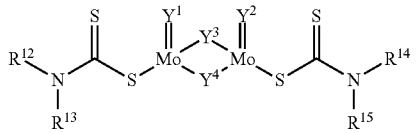

In the general formula (9), $R^{12}$ to $R^{15}$ may be the same or different, and is a $C_{2-24}$ alkyl or $C_{6-24}$ (alkyl)aryl group, preferably a $C_{4-13}$ alkyl or $C_{10-15}$ (alkyl)aryl group. The alkyl group may be a primary, secondary, or tertiary alkyl group, and may be linear or branched. "(Alkyl)aryl group" means "aryl or alkylaryl group". In the alkylaryl group, the alkyl substituent may be in any position of the aromatic ring. $Y^1$ to $Y^4$ are each independently a sulfur atom or oxygen atom. At least one of $Y^1$ to $Y^4$ is a sulfur atom.

Examples of oil-soluble organic molybdenum compounds other than the component (D1) include molybdenum dithiophosphate; any complex of a molybdenum compound (e.g. molybdenum oxide such as molybdenum dioxide and molybdenum trioxide; molybdic acid such as orthomolybdic acid, paramolybdic acid, and sulfurized (poly)molybdic acid; molybdate salt such as a metal salt and an ammonium salt of the molybdic acid; molybdenum sulfide such as molybdenum disulfide, molybdenum trisulfide, molybdenum pentasulfide, and molybdenum polysulfide; sulfurized molybdic acid, and a metal salt or amine salt thereof; and molybdenum halide such as molybdenum chloride) and a sulfur-containing organic compound (such as alkyl (thio) xanthate, thiadiazole, mercaptothiadiazole, thiocarbonate, tetrahydrocarbyl thiuram disulfide, bis(di(thio)hydrocarbyl dithiophosphonate) disulfide, organic (poly)sulfide, and sulfurized ester) or another organic compound; and sulfur-containing organic molybdenum compounds such as any complex of a sulfur-containing molybdenum compound (such as the above described molybdenum sulfide and sulfurized molybdic acid), and an alkenylsuccinimide. These organic molybdenum compounds may be mononuclear molybdenum compounds, or polynuclear molybdenum compounds such as binuclear and trinuclear molybdenum compounds.

As an oil-soluble organic molybdenum compound other than the component (D1), an organic molybdenum compound that does not contain sulfur can be also used. Examples of organic molybdenum compounds that do not contain sulfur include: a molybdenum-amine complex, a molybdenum-succinimide complex, a molybdenum salt of any organic acid, and a molybdenum salt of any alcohol. Among them, a molybdenum-amine complex, a molybdenum salt of any organic acid, or a molybdenum salt of any alcohol is preferable.

When the lubricating oil composition comprises the molybdenum friction modifier, the content thereof is, in terms of molybdenum on the basis of the total mass of the composition, normally 100 to 2000 mass ppm, preferably no more than 1500 mass ppm, more preferably no more than 1200 mass ppm, and further preferably no more than 1000 mass ppm. The content of the molybdenum friction modifier at this lower limit or over can further improve fuel efficiency and LSPI suppression. The content of the molybdenum friction modifier at this upper limit or below can improve the storage stability of the lubricating oil composition.

Any compound usually used as an ashless friction modifier for lubricating oils can be used as the ashless friction modifier without particular limitation. Examples of the ashless friction modifier include a compound having one or more heteroatom(s) selected from oxygen, nitrogen, and sulfur in the molecule, and having a carbon number of 6 to 50. More specific examples thereof include ashless friction modifiers such as an amine compound, fatty acid esters, fatty acid amides, fatty acids, aliphatic alcohols, aliphatic ethers, aliphatic ureas, and fatty acid hydrazides, each having at least one $C_{6-30}$ alkyl or alkenyl group, especially a linear alkyl group, a linear alkenyl group, a branched alkyl group, or a branched alkenyl group having a carbon number of 6-30 in the molecule.

When the lubricating oil composition comprises the ashless friction modifier, the content thereof is usually 0.1 to 1.0 mass ppm, and preferably 0.3 to 0.8 mass ppm, on the basis of the total mass of the composition. The content of the ashless friction modifier at this lower limit or over can further improve fuel efficiency. The content thereof at this upper limit or below makes it easy to prevent effect of an anti-wear agent etc. from being blocked, and makes it easy to improve solubility of an additive.

<(E) Nitrogen-Containing Ashless Dispersant>

The lubricating oil composition of the present invention may comprise (E) a nitrogen-containing ashless dispersant (hereinafter may be referred to as "component (E)").

Examples of the component (E) include at least one compound selected from the following (E-1) to (E-3):

(E-1) succinimide having at least one alkyl or alkenyl group in its molecule, or any derivative thereof (hereinafter may be referred to as "component (E-1)");

(E-2) benzylamine having at least one alkyl or alkenyl group in its molecule, or any derivative thereof (hereinafter may be referred to as "component (E-2)"); and (E-3) polyamine having at least one alkyl or alkenyl group in its molecule, or any derivative thereof (hereinafter may be referred to as "component (E-3)").

The component (E-1) can be especially preferably used as the component (E).

Among the examples of the component (E-1), examples of succinimide having at least one alkyl or alkenyl group in its molecule include any compound represented by the following formula (10) or (11).

(10)

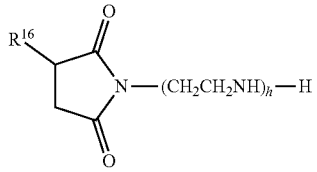

(11)

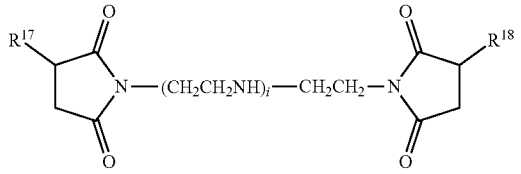

In the formula (10), $R^{16}$ is a $C_{40-400}$ alkyl or alkenyl group; h represents an integer of 1 to 5, preferably 2 to 4. The carbon number of $R^{16}$ is preferably 60 to 350.

In the formula (11), $R^{17}$ and $R^{18}$ are each independently $C_{40-400}$ alkyl or alkenyl group, and may be combination of different groups. i represents an integer of 0 to 4, preferably 1 to 4, and more preferably 1 to 3. The carbon numbers of $R^{17}$ and $R^{18}$ are each preferably 60 to 350.

The carbon numbers of $R^{16}$ to $R^{18}$ in the formulae (10) and (11) at these lower limits or over make it possible to obtain good solubility in the lubricating base oil. The carbon numbers of $R^{16}$ to $R^{18}$ at these upper limits or below can improve the low-temperature fluidity of the lubricating oil composition.

The alkyl or alkenyl groups ($R^{16}$ to $R^{18}$) in the formulae (10) and (11) may be linear or branched. Preferred examples thereof include branched alkyl groups and branched alkenyl groups derived from oligomers of olefins such as propene, 1-butene, and isobutene, or from co-oligomers of ethylene and propylene. Among them, a branched alkyl or alkenyl group derived from any oligomer of isobutene which is conventionally referred to as polyisobutylene, or a polybutenyl group is most preferable.

Preferred number average molecular weights of the alkyl or alkenyl groups ($R^{16}$ to $R^{18}$) in the formulae (10) and (11) are each 800 to 3500.

Succinimide having at least one alkyl or alkenyl group in its molecule includes so-called monotype succinimide represented by the formula (10) where addition of succinic anhydride has occurred at only one end of a polyamine chain, and so-called bistype succinimide represented by the formula (11) where addition of succinic anhydrides has occurred at both ends of a polyamine chain. The lubricating oil composition of the present invention may include either monotype or bistype succinimide, or may include both of them as a mixture.

The method for producing succinimide having at least one alkyl or alkenyl group in its molecule is not specifically limited. For example, such succinimide can be obtained by: reacting an alkyl succinic acid or an alkenyl succinic acid obtained by reacting a compound having a $C_{40-400}$ alkyl or alkenyl group with maleic anhydride at 100 to 200° C., with a polyamine. Here, examples of polyamines include diethylenetriamine, triethylenetetramine, tetraethylenepentamine, and pentaethylenehexamine.

Among the examples of the component (E-2), examples of benzylamine having at least one alkyl or alkenyl group in its molecule include any compound represented by the following formula (12).

(12)

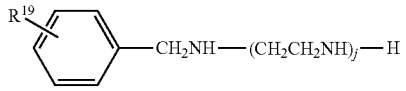

In the formula (12), $R^{19}$ is a $C_{40-400}$ alkyl or alkenyl group; and j represents an integer of 1 to 5, preferably 2 to 4. The carbon number of $R^{19}$ is preferably 60 to 350.

The method for producing the component (E-2) is not specifically limited. An example thereof is: reacting a polyolefin such as propylene oligomer, polybutene, and ethylene-α-olefin copolymer, with phenol, to give an alkylphenol; and then reacting the alkylphenol with formaldehyde, and a polyamine such as diethylenetriamine, triethylenetetramine, tetraethylenepentamine, and pentaethylenehexamine, by Mannich reaction.

Among the examples of the component (E-3), examples of a polyamine having at least one alkyl or alkenyl group in its molecule include any compound represented by the following formula (13).

$$R^{20}—NH—(CH_2CH_2NH)_k—H \quad (13)$$

In the formula (13), $R^{20}$ is a $C_{40-400}$ alkyl or alkenyl group, and k represents an integer of 1 to 5, preferably 2 to 4. The carbon number of $R^{20}$ is preferably 60 to 350.

The method for producing the component (E-3) is not specifically limited. An example thereof is: chlorinating a polyolefin such as propylene oligomer, polybutene, and ethylene-α-olefin copolymer; and then reacting the chlorinated polyolefin with ammonia, or a polyamine such as ethylenediamine, diethylenetriamine, triethylenetetramine, tetraethylenepentamine, and pentaethylenehexamine.

Examples of derivatives in the components (E-1) to (E-3) include:

(i) oxygen-containing organic compound-modified compound where a part or all of the residual amino and/or imino groups is/are neutralized or amidated by reacting succinimide, benzylamine, or polyamine having at least one alkyl or alkenyl group in its molecule as described above (hereinafter referred to as "the above described nitrogen-containing compound") with a $C_{1-30}$ monocarboxylic acid such as fatty acids, a $C_{2-30}$ polycarboxylic acid (such as ethanedioic acid, phthalic acid, trimellitic acid, and pyromellitic acid), an anhydride or ester thereof, a $C_{2-6}$ alkylene oxide, or a hydroxy(poly)oxyalkylene carbonate;

(ii) boron-modified compound where a part or all of the residual amino and/or imino groups is/are neutralized or amidated by reacting the above described nitrogen-containing compound with boric acid;

(iii) phosphoric acid-modified compound where a part or all of the residual amino and/or imino groups is/are neutralized or amidated by reacting the above described nitrogen-containing compound with phosphoric acid;

(iv) sulfur-modified compound obtained by reacting the above described nitrogen-containing compound with a sulfur compound; and (v) modified compound obtained by two or more modifications selected from oxygen-containing organic compound-modification, boron-modification, phosphoric acid-modification, and sulfur-modification, on the above described nitrogen-containing compound. Among the derivatives (i) to (v), a boron-modified compound of alkenylsuccinimide, especially a boron-modified compound of bistype alkenylsuccinimide can be preferably used.

The molecular weight of the component (E) is not specifically limited, but a preferred weight average molecular weight thereof is 1000 to 20000.

When the lubricating oil composition comprises the component (E), the content thereof is, in terms of nitrogen on the basis of the total mass of the composition, preferably 100 to 1500 mass ppm, more preferably 300 to 1000 mass ppm, and further preferably 500 to 1000 mass ppm. The content of the component (E) at this lower limit or over can sufficiently improve anti-coking performance of the lubricating oil composition, to improve solubility of an additive. The content thereof at this upper limit or below makes it possible to keep higher fuel efficiency.

When the component (E) comprises boron, the boron content in the lubricating oil composition derived from the component (E) is, on the basis of the total mass of the composition, preferably no more than 400 mass ppm, more preferably no more than 350 mass ppm, and especially preferably no more than 300 mass ppm. The boron content derived from the component (E) at this upper limit or below makes it possible to keep higher fuel efficiency, and reduce the ash content of the composition.

<(G) Zinc Dialkyldithiophosphate>

The lubricating oil composition of the present invention preferably comprises a zinc dialkyl dithiophosphate (ZnDTP; hereinafter may be referred to as "component (G)") in an amount of no less than 600 mass ppm in terms of phosphorus on the basis of the total mass of the composition. For example, any compound represented by the following general formula (14) can be used as the component (G).

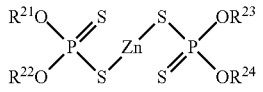

(14)

In the formula (14), $R^{21}$ to $R^{24}$ each independently represent a $C_{1-24}$ linear or branched chain alkyl group, and may be combination of different groups. The carbon numbers of $R^{21}$ to $R^{24}$ are each preferably 3 to 12, and more preferably 3 to 8. $R^{21}$ to $R^{24}$ may be each primary, secondary, and tertiary alkyl groups, and are preferably primary or secondary alkyl groups or combination thereof. Further, the molar ratio of the primary alkyl group and the secondary alkyl group (primary alkyl group:secondary alkyl group) is preferably 0:100 to 30:70. This ratio may be the intramolecular combination ratio of alkyl chains, or may be the mixing ratio of ZnDTP having only the primary alkyl group and ZnDTP having only the secondary alkyl group. When the secondary alkyl group is major, fuel efficiency can be further improved.

The method for producing the zinc dialkyldithiophosphate is not specifically restricted. For example, the zinc dialkyldithiophosphate can be synthesized by: reacting alcohol(s) having an alkyl group corresponding to $R^{21}$ to $R_{24}$ with phosphorus pentasulfide, to synthesize dithiophosphoric acid; and neutralizing the dithiophosphoric acid with zinc oxide.

The content of the component (G) is preferably 600 to 800 mass ppm in terms of phosphorous on the basis of the total mass of the composition. The content of ZnDTP at this lower limit or over can improve LSPI suppression. The content of ZnDTP at this upper limit or below makes it possible to reduce catalyst poisoning of an exhaust gas purifying catalyst.

<Other Additives>

Other additives commonly used in lubricating oils can be incorporated in the lubricating oil composition of the present invention according to its purpose in order to further improve its performance. Examples of such additives include additives such as antioxidants, anti-wear agents or extreme-pressure agents, corrosion inhibitors, anti-rust agents, metal deactivators, demulsifiers, and defoaming agents.

Any known antioxidant such as phenolic antioxidants and amine antioxidants can be used as an antioxidant. Examples thereof include: amine antioxidants such as alkylated diphenylamine, phenyl-α-naphthylamine, and alkylated α-naphthylamine; and phenolic antioxidants such as 2,6-di-t-butyl-4-methylphenol, and 4,4'-methylenebis(2,6-di-t-butylphenol).

When the lubricating oil composition comprises the antioxidant, the content thereof is usually no more than 5.0 mass %, preferably no more than 3.0 mass %, preferably no less than 0.1 mass %, and more preferably no less than 0.5 mass %, on the basis of the total mass of the composition.

Any anti-wear agent or extreme pressure agent used for lubricating oils can be used as an anti-wear agent or extreme pressure agent without particular limitation. Examples thereof include sulfur, phosphorous, and sulfur-phosphorous extreme pressure agents. Specific examples thereof include phosphite esters, thiophosphite esters, dithiophosphite esters, trithiophosphite esters, phosphate esters, thiophosphate esters, dithiophosphate esters, trithiophosphate esters, amine salts thereof, metal salts thereof, derivatives thereof, dithiocarbamates, zinc dithiocarbamate, disulfides, polysulfides, sulfurized olefins, and sulfurized oils. Among them, a sulfur extreme pressure agent, especially a sulfurized oil is preferable.

When the lubricating oil composition comprises the anti-wear agent or extreme pressure agent, the content thereof is preferably 0.01 to 10 mass % on the basis of the total mass of the composition.

Examples of corrosion inhibitors that can be used in the lubricating oil composition include known corrosion inhibitors such as benzotriazole compounds, tolyltriazole compounds, thiadiazole compounds, and imidazole compounds. When the lubricating oil composition comprises a corrosion inhibitor, the content thereof is usually 0.005 to 5 mass % on the basis of the total mass of the composition.

Examples of anti-rust agents that can be used in the lubricating oil composition include known anti-rust agents such as petroleum sulfonates, alkylbenzenesulfonates, dinonylnaphthalenesulfonates, alkylsulfonate salts, fatty acids, alkenylsuccinimide half esters, fatty acid soaps, fatty acid polyol esters, fatty acid amine salts, oxidized paraffins, and alkyl polyoxyethylene ethers. When the lubricating oil composition comprises an anti-rust agent, the content thereof is usually 0.005 to 5 mass % on the basis of the total mass of the composition.

Examples of metal deactivators that can be used in the lubricating oil composition include known metal deactivators such as imidazolines, pyrimidine derivatives, alkylthiadiazoles, mercaptobenzothiazoles, benzotriazoles and derivatives thereof, 1,3,4-thiadiazole polysulfide, 1,3,4-thiadiazolyl-2,5-bis(dialkyl dithiocarbamate), 2-(alkyldithio) benzimidazole, and 13-(o-carboxybenzylthio)propionitrile. When the lubricating oil composition comprises a metal deactivator, the content thereof is usually 0.005 to 1 mass % on the basis of the total mass of the composition.

Examples of demulsifiers that can be used in the lubricating oil composition include known demulsifiers such as polyalkylene glycol nonionic surfactants. When the lubricating oil composition comprises a demulsifier, the content thereof is usually 0.005 to 5 mass % on the basis of the total mass of the composition.

Examples of defoaming agents that can be used in the lubricating oil composition include known defoaming agents such as silicones, fluorosilicones, and fluoroalkyl ethers. When the lubricating oil composition comprises a defoaming agent, the content thereof is usually 0.0001 to 0.1 mass % on the basis of the total mass of the composition.

Examples of coloring agents that can be used in the lubricating oil composition include known coloring agents such as azo compounds.

<Lubricating Oil Composition>

The kinematic viscosity of the lubricating oil composition at 100° C. is preferably 4.0 to 6.1 $mm^2/s$, and more preferably 4.5 to 5.6 $mm^2/s$. The kinematic viscosity of the lubricating oil composition at 100° C. at this lower limit or over makes it easy to maintain lubricity. The kinematic viscosity thereof at this upper limit or below can further improve fuel efficiency.

The kinematic viscosity of the lubricating oil composition at 40° C. is preferably 4.0 to 50 $mm^2/s$, more preferably 15 to 40 $mm^2/s$, further preferably 15 to 40 $mm^2/s$, and especially preferably 20 to 35 $mm^2/s$. The kinematic viscosity of the lubricating oil composition at 40° C. at this lower limit or over makes it easy to maintain lubricity. The kinematic viscosity thereof at this upper limit or below can further improve low-temperature viscosity characteristics and fuel efficiency.

The viscosity index of the lubricating oil composition is preferably no less than 100, more preferably no less than 120, and especially preferably no less than 130. The viscosity index of the lubricating oil composition at this lower limit or over can improve fuel efficiency while maintaining the HTHS viscosity at 150° C., and further makes it possible to reduce the low-temperature viscosity (for example, at −35° C. that is measurement temperature of the CCS viscosity as defined in the SAE viscosity grade 0W-X, known as viscosity grades of fuel-economy oils).

The HTHS viscosity of the lubricating oil composition at 150° C. is preferably 1.7 to 2.0 mPa·s. In the present description, the HTHS viscosity at 150° C. means high temperature high shear viscosity at 150° C. as defined in ASTM D4683. The HTHS viscosity at 150° C. of no less than 1.7 mPa·s makes it easy to maintain lubricity. The HTHS viscosity at 150° C. of no more than 2.0 mPa·s can further improve fuel efficiency.

The HTHS viscosity of the lubricating oil composition at 100° C. is preferably 3.5 to 4.0 mPa·s, and more preferably 3.6 to 4.0 mPa·s. In the present description, the HTHS viscosity at 100° C. is high temperature high shear viscosity at 100° C. as defined in ASTM D4683. The HTHS viscosity at 100° C. of no less than 3.5 mPa·s makes it easy to maintain lubricity. The HTHS viscosity at 100° C. of no more than 4.0 mPa·s can further improve low-temperature viscosity characteristics and fuel efficiency.

The evaporation loss of the lubricating oil composition is, as NOACK evaporation loss at 250° C., preferably no more than 15 mass %, and more preferably no more than 14.5 mass %. The NOACK evaporation loss of the lubricating oil composition at this upper limit or below makes it possible to further reduce the evaporation loss of the lubricating oil, which makes it possible to further suppress deterioration of the lubricating oil at high temperatures, such as increase in the viscosity. The NOACK evaporation loss in the present description is the evaporation loss of the lubricating oil measured conforming to ASTM D 5800. The lower limit of the NOACK evaporation loss of the lubricating oil composition at 250° C. is not specifically restricted, but normally no less than 5 mass %.

EXAMPLES

Hereinafter the present invention will be more specifically described based on examples and comparative examples. The present invention is not limited to these examples.

Examples 1 to 11 and Comparative Examples 1 to 8

The lubricating oil compositions of the present invention (examples 1 to 11) and lubricating oil compositions for comparison (comparative examples 1 to 8) were prepared using the following base oils and additives. The formulation of each composition is shown in Tables 1 to 4. In Tables 1 to 4, for the items of "base oil composition", "mass %" represents mass % on the basis of the total mass of the base oils; and for the items other than the foregoing, "mass %" represents mass % on the basis of the total mass of the composition, and "mass ppm" represents mass ppm on the basis of the total mass of the composition.

(Base Oils)

O-1: Group III base oil of API base stock categories (wax isomerized mineral base oil obtained by hydrocracking/hydroisomerizing n-paraffin-containing oil), kinematic viscosity (100° C.): 2.62 $mm^2/s$, kinematic viscosity (40° C.): 9.06 $mm^2/s$, viscosity index: 127, NOACK evaporation loss (250° C., 1 h): 45 mass %, % $C_P$: 90.2, % $C_N$: 9.8, % $C_A$: 0, saturated content: 99.6 mass %, aromatic content: 0.2 mass %, resin content: 0.2 mass %

O-2: Group III base oil of API base stock categories (wax isomerized mineral base oil obtained by hydrocracking/hydroisomerizing n-paraffin-containing oil), kinematic viscosity (100° C.): 3.83 $mm^2/s$, kinematic viscosity (40° C.): 15.6 $mm^2/s$, viscosity index: 142, NOACK evaporation loss (250° C., 1 h): 14 mass %, % $C_P$: 93.3, % $C_N$: 6.7, % $C_A$: 0, saturated content: 99.6 mass %, aromatic content: 0.2 mass %, resin content: 0.1 mass %

O-3: Group II base oil of API base stock categories (hydrocracked mineral base oil, Yubase™ 3 from SK Lubricants Co., Ltd.), kinematic viscosity (100° C.): 3.05 $mm^2/s$, kinematic viscosity (40° C.): 12.3 $mm^2/s$, viscosity index: 105, NOACK evaporation loss (250° C., 1 h): 40 mass %, % $C_P$: 72.6, % $C_N$: 27.4, % $C_A$: 0, saturated content: 99.6 mass %, aromatic content: 0.3 mass %, resin content: 0.1 mass %

O-4: Group III base oil of API base stock categories (hydrocracked mineral base oil, Yubase™ 4 from SK Lubricants Co., Ltd.), kinematic viscosity (100° C.): 4.24 $mm^2/s$, kinematic viscosity (40° C.): 19.3 $mm^2/s$, viscosity index: 127, NOACK evaporation loss (250° C., 1 h): 14.7 mass %, % $C_P$: 80.7, % $C_N$: 19.3, % $C_A$: 0, saturated content: 99.7 mass %, aromatic content: 0.2 mass %, resin content: 0.1 mass %

O-5: Group IV base oil of API base stock categories (poly α-olefin base oil, SpectraSyn™ 2 from ExxonMobil Chemical Company), kinematic viscosity (100° C.): 1.69 $mm^2/s$, kinematic viscosity (40° C.): 5.06 $mm^2/s$, NOACK evaporation loss (250° C., 1 h): 10.0 mass %

O-6: Group IV base oil of API base stock categories (poly α-olefin base oil, SpectraSyn™ 4 from ExxonMobil Chemical Company), kinematic viscosity (100° C.): 4.07 $mm^2/s$, kinematic viscosity (40° C.): 18.2 $mm^2/s$, viscosity index: 125, NOACK evaporation loss (250° C., 1 h): 12.7 mass %

O-7: Group III base oil of API base stock categories (hydrocracked mineral base oil, Yubase™ 4 PLUS from SK Lubricants Co., Ltd.), kinematic viscosity (100° C.): 4.15 $mm^2/s$, kinematic viscosity (40° C.): 18.7 $mm^2/s$, viscosity index: 135, NOACK evaporation loss (250° C., 1 h): 13.5 mass %, % $C_P$: 87.3, % $C_N$: 12.7, % $C_A$: 0, saturated content: 99.6 mass %, aromatic content: 0.2 mass %, resin content: 0.2 mass %

(Metallic Detergents)

A-1: calcium carbonate-overbased calcium salicylate, Ca content: 8.0 mass %, base number (perchloric acid method): 225 mgKOH/g B-1: magnesium carbonate-overbased magnesium sulfonate, Mg content: 9.1 mass %, base number (perchloric acid method): 405 mgKOH/g (Viscosity Index Improver)

C-1: non-dispersant polymethacrylate viscosity index improver, weight average molecular weight: 400,000, monomer composition (molar ratio): M-1:M-2:M-3=6:2:2

(Friction Modifier)

D-1: sulfurized (oxy)molybdenum dithiocarbamate (molybdenum friction modifier), Mo content: 10 mass %

(Ashless Dispersant)

E-1: polybutenyl succinimide, N content: 1.6 mass %, B content: 0 mass %

(Antioxidant)

F-1: amine antioxidant (diphenylamine)

F-2: hindered phenol antioxidant (ZnDTP)

G-1: zinc dialkyldithiophosphate, P content: 7.2 mass %, S content: 14.1 mass %, Zn content: 7.85 mass %

TABLE 1

| | | Examples | | | | |
|---|---|---|---|---|---|---|
| | | 1 | 2 | 3 | 4 | 5 |
| Base oil composition | | | | | | |
| O-1 | mass % | — | 3 | 3 | 3 | 3 |
| O-2 | mass % | 100 | 97 | 97 | 97 | 97 |
| O-3 | mass % | — | — | — | — | — |
| O-4 | mass % | — | — | — | — | — |
| O-5 | mass % | — | — | — | — | — |
| O-6 | mass % | — | — | — | — | — |
| O-7 | mass % | — | — | — | — | — |
| Total | mass % | 100 | 100 | 100 | 100 | 100 |
| Properties of base oil | | | | | | |
| Kinematic viscosity (40° C.) | $mm^2/s$ | 15.6 | 15.3 | 15.3 | 15.3 | 15.3 |
| Kinematic viscosity (100° C.) | $mm^2/s$ | 3.8 | 3.8 | 3.8 | 3.8 | 3.8 |
| Viscosity index | | 142 | 142 | 142 | 142 | 142 |
| NOACK evaporation loss (250° C., 1 h) | mass % | 14.0 | 14.9 | 14.9 | 14.9 | 14.9 |
| Total base oil | mass % | 91.2 | 91.2 | 90.4 | 90.2 | 88.2 |
| Metallic detergent | | | | | | |
| A-1 | mass % | 1.75 | 1.75 | 1.75 | 1.75 | 1.75 |
| B-1 | mass % | 0.45 | 0.45 | 0.45 | 0.45 | 0.45 |
| Viscosity index improver | | | | | | |
| C-1 | mass % | 0.00 | 0.00 | 0.80 | 1.00 | 3.00 |
| Friction modifier | | | | | | |
| D-1 | mass % | 0.80 | 0.80 | 0.80 | 0.80 | 0.80 |
| Ashless dispersant | | | | | | |
| E-1 | mass % | 4.00 | 4.00 | 4.00 | 4.00 | 4.00 |
| Antioxidant | | | | | | |
| F-1 | mass % | 0.40 | 0.40 | 0.40 | 0.40 | 0.40 |
| F-2 | mass % | 0.40 | 0.40 | 0.40 | 0.40 | 0.40 |
| ZnDTP | | | | | | |
| G-1 | mass % | 1.00 | 1.00 | 1.00 | 1.00 | 1.00 |
| Total | mass % | 100 | 100 | 100 | 100 | 100 |
| Properties of composition | | | | | | |
| Kinematic viscosity (40° C.) | $mm^2/s$ | 20.9 | 20.6 | 21.0 | 21.1 | 22.1 |
| Kinematic viscosity (100° C.) | $mm^2/s$ | 4.7 | 4.7 | 4.8 | 4.8 | 5.2 |
| Viscosity index | | 152 | 152 | 158 | 160 | 178 |
| HTHS viscosity (100° C.) | mPa · s | 3.65 | 3.61 | 3.69 | 3.70 | 3.83 |

TABLE 1-continued

| | | Examples | | | | |
|---|---|---|---|---|---|---|
| | | 1 | 2 | 3 | 4 | 5 |
| HTHS viscosity (150° C.) | mPa · s | 1.74 | 1.70 | 1.74 | 1.76 | 1.86 |
| NOACK evaporation loss (250° C., 1 h) | mass % | 13.4 | 14.1 | 14.1 | 14.0 | 14.2 |
| Elemental analysis | | | | | | |
| B | mass ppm | <1 | <1 | <1 | <1 | <1 |
| Ca | mass ppm | 1400 | 1400 | 1400 | 1400 | 1400 |
| Mg | mass ppm | 420 | 420 | 420 | 420 | 420 |
| Mo | mass ppm | 800 | 800 | 800 | 800 | 800 |
| P | mass ppm | 720 | 720 | 720 | 720 | 720 |
| S | mass % | 0.23 | 0.23 | 0.23 | 0.23 | 0.23 |
| Zn | mass ppm | 790 | 790 | 790 | 790 | 790 |
| N | mass ppm | 900 | 900 | 900 | 900 | 900 |
| Panel coking test | | | | | | |
| Coke deposited on the panel | mg | 19.2 | 20.8 | 169.5 | 218.0 | 254.0 |
| Hot tube test | score | — | 6.5 | — | — | — |
| LSPI frequency index | | 0.29 | 0.29 | 0.29 | 0.29 | 0.29 |

TABLE 2

| | | Examples | | | | |
|---|---|---|---|---|---|---|
| | | 6 | 7 | 8 | 9 | 10 |
| Base oil composition | | | | | | |
| O-1 | mass % | 3 | — | — | 3 | 3 |
| O-2 | mass % | 97 | 96.5 | — | 97 | 97 |
| O-3 | mass % | — | 3.5 | — | — | — |
| O-4 | mass % | — | — | — | — | — |
| O-5 | mass % | — | — | 2.5 | — | — |
| O-6 | mass % | — | — | 97.5 | — | — |
| O-7 | mass % | — | — | — | — | — |
| Total | mass % | 100 | 100 | 100 | 100 | 100 |
| Properties of base oil | | | | | | |
| Kinematic viscosity (40° C.) | $mm^2/s$ | 15.3 | 15.5 | 17.5 | 15.3 | 15.3 |
| Kinematic viscosity (100° C.) | $mm^2/s$ | 3.8 | 3.8 | 4.0 | 3.8 | 3.8 |
| Viscosity index | | 142 | 140 | 124 | 142 | 142 |
| NOACK evaporation toss (250° C., 1 h) | mass % | 14.9 | 14.9 | 14.9 | 14.9 | 14.9 |
| Total base oil | mass % | 86.2 | 91.2 | 91.2 | 91.8 | 91.5 |
| Metallic detergent | | | | | | |
| A-1 | mass % | 1.75 | 1.75 | 1.75 | 1.75 | 1.75 |
| B-1 | mass % | 0.45 | 0.45 | 0.45 | 0.45 | 0.45 |
| Viscosity index improver | | | | | | |
| C-1 | mass % | 5.00 | 0.00 | 0.00 | 0.00 | 0.00 |
| Friction modifier | | | | | | |
| D-1 | mass % | 0.80 | 0.80 | 0.80 | 0.00 | 0.40 |
| Ashless dispersant | | | | | | |
| E-1 | mass % | 4.00 | 4.00 | 4.00 | 4.00 | 4.00 |
| Antioxidant | | | | | | |
| F-1 | mass % | 0.40 | 0.40 | 0.40 | 0.40 | 0.40 |
| F-2 | mass % | 0.40 | 0.40 | 0.40 | 0.40 | 0.40 |
| ZnDTP | | | | | | |
| G-1 | mass % | 1.00 | 1.00 | 1.00 | 1.22 | 1.11 |
| Total | mass % | 100 | 100 | 100 | 100 | 100 |

TABLE 2-continued

| | | Examples | | | | |
|---|---|---|---|---|---|---|
| | | 6 | 7 | 8 | 9 | 10 |
| Properties of composition | | | | | | |
| Kinematic viscosity (40° C.) | $mm^2/s$ | 23.2 | 20.5 | 23.6 | 20.4 | 20.7 |
| Kinematic viscosity (100° C.) | $mm^2/s$ | 5.5 | 4.7 | 4.9 | 4.7 | 4.7 |
| Viscosity index | | 192 | 152 | 138 | 156 | 153 |
| HTHS viscosity (100° C.) | mPa · s | 3.95 | 3.63 | 3.84 | 3.63 | 3.64 |
| HTHS viscosity (150° C.) | mPa · s | 1.95 | 1.69 | 1.73 | 1.78 | 1.77 |
| NOACK evaporation loss (250° C., 1 h) | mass % | 14.4 | 14.3 | 12.2 | 13.6 | 14.0 |
| Elemental analysis | | | | | | |
| B | mass ppm | <1 | <1 | <1 | <1 | <1 |
| Ca | mass ppm | 1400 | 1400 | 1400 | 1400 | 1400 |
| Mg | mass ppm | 420 | 420 | 420 | 420 | 420 |
| Mo | mass ppm | 800 | 800 | 800 | 0 | 400 |
| P | mass ppm | 720 | 720 | 720 | 880 | 800 |
| S | mass % | 0.23 | 0.23 | 0.23 | 0.19 | 0.21 |
| Zn | mass ppm | 790 | 790 | 790 | 960 | 870 |
| N | mass ppm | 900 | 900 | 900 | 810 | 840 |
| Panel coking test | | | | | | |
| Coke deposited on the panel | mg | 289.2 | 28.3 | 20.2 | 7.8 | 14.9 |
| Hot tube test | score | — | — | — | — | — |
| LSPI frequency index | | 0.29 | 0.29 | 0.29 | 0.27 | 0.28 |

TABLE 3

| | | Example | Comparative examples | | |
|---|---|---|---|---|---|
| | | 11 | 1 | 2 | 3 |
| Base oil composition | | | | | |
| O-1 | mass % | 3 | 3 | 11.5 | 3 |
| O-2 | mass % | 97 | 97 | — | 97 |
| O-3 | mass % | — | — | — | — |
| O-4 | mass % | — | — | 88.5 | — |
| O-5 | mass % | — | — | — | — |
| O-6 | mass % | — | — | — | — |
| O-7 | mass % | — | — | — | — |
| Total | mass % | 100 | 100 | 100 | 100 |
| Properties of base oil | | | | | |
| Kinematic viscosity (40° C.) | $mm^2/s$ | 15.3 | 15.3 | 17.5 | 15.3 |
| Kinematic viscosity (100° C.) | $mm^2/s$ | 3.8 | 3.8 | 4.0 | 3.8 |
| Viscosity index | | 142 | 142 | 127 | 142 |
| NOACK evaporation loss (250° C., 1 h) | mass % | 14.9 | 14.9 | 18.2 | 14.9 |
| Total base oil | mass % | 93.3 | 81.2 | 91.2 | 90.9 |
| Metallic detergent | | | | | |
| A-1 | mass % | 1.25 | 1.75 | 1.75 | 2.50 |
| B-1 | mass % | 0.45 | 0.45 | 0.45 | 0.00 |
| Viscosity index improver | | | | | |
| C-1 | mass % | 0.00 | 10.00 | 0.00 | 0.00 |
| Friction modifier | | | | | |
| D-1 | mass % | 0.00 | 0.80 | 0.80 | 0.80 |

TABLE 3-continued

| | | Example | Comparative examples | | |
|---|---|---|---|---|---|
| | | 11 | 1 | 2 | 3 |
| Ashless dispersant | | | | | |
| E-1 | mass % | 4.00 | 4.00 | 4.00 | 4.00 |
| Antioxidant | | | | | |
| F-1 | mass % | 0.00 | 0.40 | 0.40 | 0.40 |
| F-2 | mass % | 0.00 | 0.40 | 0.40 | 0.40 |
| ZnDTP | | | | | |
| G-1 | mass % | 1.00 | 1.00 | 1.00 | 1.00 |
| Total | mass % | 100 | 100 | 100 | 100 |
| Properties of composition | | | | | |
| Kinematic viscosity (40° C.) | $mm^2/s$ | 20.1 | 26.1 | 23.5 | 21.0 |
| Kinematic viscosity (100° C.) | $mm^2/s$ | 4.6 | 6.6 | 4.9 | 4.8 |
| Viscosity index | | 152 | 228 | 138 | 153 |
| HTHS viscosity (100° C.) | mPa · s | 3.57 | 4.34 | 3.92 | 3.71 |
| HTHS viscosity (150° C.) | mPa · s | 1.70 | 2.25 | 1.77 | 1.75 |
| NOACK evaporation loss (250° C., 1 h) | mass % | 14.2 | 14.3 | 16.9 | 14.1 |
| Elemental analysis | | | | | |
| B | mass ppm | <1 | <1 | <1 | <1 |
| Ca | mass ppm | 1000 | 1400 | 1400 | 2000 |

TABLE 3-continued

| | | Example | Comparative examples | | |
|---|---|---|---|---|---|
| | | 11 | 1 | 2 | 3 |
| Mg | mass ppm | 420 | 420 | 420 | <10 |
| Mo | mass ppm | 0 | 800 | 800 | 800 |
| P | mass ppm | 720 | 720 | 720 | 720 |
| S | mass % | 0.15 | 0.23 | 0.23 | 0.23 |
| Zn | mass ppm | 790 | 790 | 790 | 790 |
| N | mass ppm | 670 | 900 | 900 | 900 |

TABLE 3-continued

| | | Example | Comparative examples | | |
|---|---|---|---|---|---|
| | | 11 | 1 | 2 | 3 |
| Panel coking test | | | | | |
| Coke deposited on the panel | mg | 3.0 | 377.4 | 36.2 | 20.6 |
| Hot tube test | score | — | — | — | — |
| LSPI frequency index | | 0.43 | 0.29 | 0.29 | 0.68 |

TABLE 4

| | | Comparative examples | | | | |
|---|---|---|---|---|---|---|
| | | 4 | 5 | 6 | 7 | 8 |
| Base oil composition | | | | | | |
| O-1 | mass % | — | 3 | 3 | 3 | 3 |
| O-2 | mass % | — | 97 | 97 | 97 | 97 |
| O-3 | mass % | 5 | — | — | — | — |
| O-4 | mass % | — | — | — | — | — |
| O-5 | mass % | — | — | — | — | — |
| O-6 | mass % | — | — | — | — | — |
| O-7 | mass % | 95 | — | — | — | — |
| Total | mass % | 100 | 100 | 100 | 100 | 100 |
| Properties of base oil | | | | | | |
| Kinematic viscosity (40° C.) | $mm^2/s$ | 18.3 | 15.3 | 15.3 | 15.3 | 15.3 |
| Kinematic viscosity (100° C.) | $mm^2/s$ | 4.1 | 3.8 | 3.8 | 3.8 | 3.8 |
| Viscosity index | | 125 | 142 | 142 | 142 | 142 |
| NOACK evaporation loss (250° C., 1 h) | mass % | 14.8 | 14.9 | 14.9 | 14.9 | 14.9 |
| Total base oil | mass % | 86.2 | 90.5 | 91.8 | 90.3 | 91.6 |
| Metallic detergent | | | | | | |
| A-1 | mass % | 1.75 | 2.50 | 1.12 | 1.75 | 1.75 |
| B-1 | mass % | 0.45 | 0.45 | 0.45 | 1.32 | 0.05 |
| Viscosity index improver | | | | | | |
| C-1 | mass % | 5.00 | 0.00 | 0.00 | 0.00 | 0.00 |
| Friction modifier | | | | | | |
| D-1 | mass % | 0.80 | 0.80 | 0.80 | 0.80 | 0.80 |
| Ashless dispersant | | | | | | |
| E-1 | mass % | 4.00 | 4.00 | 4.00 | 4.00 | 4.00 |
| Antioxidant | | | | | | |
| F-1 | mass % | 0.40 | 0.40 | 0.40 | 0.40 | 0.40 |
| F-2 | mass % | 0.40 | 0.40 | 0.40 | 0.40 | 0.40 |
| ZnDTP | | | | | | |
| G-1 | mass % | 1.00 | 1.00 | 1.00 | 1.00 | 1.00 |
| Total | mass % | 100 | 100 | 100 | 100 | 100 |
| Properties of composition | | | | | | |
| Kinematic viscosity (40° C.) | $mm^2/s$ | 26.8 | 21.2 | 20.5 | 21.2 | 20.6 |
| Kinematic viscosity (100° C.) | $mm^2/s$ | 6.0 | 4.8 | 4.7 | 4.8 | 4.7 |
| Viscosity index | | 182 | 155 | 154 | 156 | 154 |
| HTHS viscosity (100° C.) | mPa · s | 4.35 | 3.73 | 3.63 | 3.75 | 3.66 |
| HTHS viscosity (150° C.) | mPa · s | 2.12 | 1.78 | 1.74 | 1.78 | 1.76 |
| NOACK evaporation loss (250° C., 1 h) | mass % | 14.0 | 14.2 | 14.1 | 14.2 | 14.1 |

TABLE 4-continued

| | | Comparative examples | | | | |
|---|---|---|---|---|---|---|
| | | 4 | 5 | 6 | 7 | 8 |
| Elemental analysis | | | | | | |
| B | mass ppm | <1 | <1 | <1 | <1 | <1 |
| Ca | mass ppm | 1400 | 2000 | 900 | 1400 | 1400 |
| Mg | mass ppm | 420 | 420 | 420 | 1200 | 50 |
| Mo | mass ppm | 800 | 800 | 800 | 800 | 800 |
| P | mass ppm | 720 | 720 | 720 | 720 | 720 |
| S | mass ppm | 0.23 | 0.23 | 0.23 | 0.25 | 0.23 |
| Zn | mass ppm | 790 | 790 | 790 | 790 | 790 |
| N | mass ppm | 900 | 890 | 890 | 890 | 890 |
| Panel coking test | | | | | | |
| Coke deposited on the panel | mg | 294 | 29.2 | 29.5 | 79.6 | 26.6 |
| Hot tube test | score | — | — | 4.5 | 6.5 | 3.5 |
| LSPI frequency index | | 0.29 | 0.68 | 0 | 0.29 | 0.29 |

(Panel Coking Test)

Detergency of each of the lubricating oil compositions was evaluated using a panel coking test. Conforming to Tentative Standard Method 3462-T of Federal 791 Test Method, the sequence of 15 seconds of mechanically splashing a sample oil (oil temperature: 100° C.) against a panel (panel temperature: 300° C.) by means of a bar followed by 45 seconds of an interval was repeated for 3 hours, and thereafter the amount of coke deposited on the panel after the test was measured. The results are shown in Tables 1 to 4.

(Hot Tube Test)

Detergency of each of the lubricating oil compositions was evaluated by a hot tube test conforming to Method A in JPI-5S-55-99. The test was carried out at 280° C. The results are shown in Tables 1 to 4. Scores are 0 to 10. Higher scores mean better detergency.

(LSPI Frequency)

Non Patent Literature 1 reports that LSPI occurrence frequency when a lubricating oil composition is used for lubrication of an internal combustion engine shows a positive correlation with the Ca content in the lubricating oil composition, and shows negative correlations with the P content and Mo content in the lubricating oil composition. More specifically, Non Patent Literature 1 reports that LSPI occurrence frequency can be estimated by the following regression formula, based on contents of respective elements in the lubricating oil composition:

$$\text{LSPI frequency index}=6.59\times[\text{Ca}]-26.6\times[\text{P}]-5.12\times[\text{Mo}]+1.69 \quad (15)$$

In the equation (15), [Ca] represents the calcium content in the composition (mass %), [P] represents the phosphorous content in the composition (mass %), and [Mo] represents the molybdenum content in the composition (mass %).

The LSPI frequency index of each of the compositions of the examples and comparative examples according to the equation (15) is shown in Tables 1 to 4. A LSPI frequency index calculated by the equation (15) is a relative value based on the LSPI frequency when a conventionally known engine oil (API SM OW-20) is used. That is, the LSPI frequency index by the equation (15) is normalized so that the value calculated from the formulation of the engine oil API SM OW-20 is 1. For example, when a LSPI frequency index calculated from the formulation of some lubricating oil composition according to the equation (15) is 0.5, the LSPI frequency when the lubricating oil composition is used for lubrication of an internal combustion engine is estimated to be 50% of the LSPI frequency when the conventionally known engine oil API SM OW-20 is used.

All the compositions of examples 1 to 11 had low viscosity and excellent fuel efficiency, and also had excellent LSPI suppression, lubricating oil consumption suppression, and detergency.

The composition of comparative example 1 containing too much a viscosity index improver was inferior in detergency.

The composition of comparative example 2 having too high a NOACK evaporation loss of the base oil was inferior in lubricating oil consumption suppression.

The compositions of comparative examples 3 and 5 having too high calcium contents derived from the metallic detergents were inferior in LSPI suppression.

The composition of comparative example 4 comprising the base oil having too high a kinetic viscosity at 100° C. was inferior in fuel efficiency.

The compositions of comparative examples 6 and 8 having too low calcium or magnesium contents derived from the metallic detergents were inferior in detergency to the composition of example 2, which offers a fair comparison.

The composition of comparative example 7 having too high a magnesium content derived from the metallic detergents was inferior in detergency to the composition of example 2, which offers a fair comparison.

It can be seen from the foregoing results that the lubricating oil composition for an internal combustion engine of the present invention can improve fuel efficiency, LSPI suppression, lubricating oil consumption suppression, and detergency in a well-balanced manner.

INDUSTRIAL APPLICABILITY

The lubricating oil composition for an internal combustion engine of the present invention can improve fuel efficiency, LSPI suppression, lubricating oil consumption suppression, and detergency in a well-balanced manner. Thus, the lubricating oil composition of the present invention can be preferably used for lubrication of turbocharged gasoline engines, especially turbocharged direct injection engines which tend to suffer the problem of LSPI.

We claim:

1. A lubricating oil composition for an internal combustion engine, the composition comprising:

a lubricant base oil comprising
at least one mineral base oil,
at least one synthetic base oil, or
any combination thereof, the lubricant base oil having a kinematic viscosity at 100° C. of 3.0 to 4.0 $mm^2/s$ and a NOACK evaporation loss at 250° C. of no more than 15 mass %;

(A) a calcium-containing metallic detergent in an amount of no less than 1000 mass ppm and less than 2000 mass ppm in terms of calcium on the basis of the total mass of the composition;

(B) a magnesium-containing metallic detergent in an amount of 100 to 1000 mass ppm in terms of magnesium on the basis of the total mass of the composition;

(G) a zinc dialkyl dithiophosphate in an amount of no less than 600 mass ppm in terms of phosphorus on the basis of the total mass of the composition;

an oil-soluble organic molybdenum compound in an amount of no less than 100 mass ppm in terms of molybdenum on the basis of the total mass of the composition, and such that the composition has a molybdenum content of no more than 400 mass ppm on the basis of the total mass of the composition; and optionally (C) a viscosity index improver in an amount of no more than 3 mass % on the basis of the total mass of the composition, wherein a boron content in the composition is less than 1 mass ppm on the basis of the total mass of the composition.

2. The lubricating oil composition according to claim 1, the component (C) comprising (C1) a poly(meth)acrylate viscosity index improver having a weight average molecular weight of no less than 100,000, in an amount of no less than 95 mass % on the basis of the total amount of the component (C).

3. The lubricating oil composition according to claim 1, wherein the composition optionally comprises the component (C) in an amount of no more than 1 mass % on the basis of the total mass of the composition.

4. The lubricating oil composition according to claim 1, wherein the composition does not comprise the component (C).

5. The lubricating oil composition according to claim 1, wherein the lubricant base oil is at least one synthetic base oil.

6. The lubricating oil composition according to claim 1, wherein the composition has a HTHS viscosity at 150° C. of 1.7 to 2.0 mPa·s.

7. The lubricating oil composition according to claim 1, wherein the composition has a HTHS viscosity at 100° C. of 3.5 to 4.0 mPa·s.

8. The lubricating oil composition according to claim 1, wherein the composition has a NOACK evaporation loss at 250° C. of no more than 15 mass %.

* * * * *